US006974920B2

(12) United States Patent
Yu

(10) Patent No.: US 6,974,920 B2
(45) Date of Patent: Dec. 13, 2005

(54) MULTI-DIRECTIONAL SWITCH

(75) Inventor: Jen-Chen Yu, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 333 days.

(21) Appl. No.: 10/634,055

(22) Filed: Aug. 4, 2003

(65) Prior Publication Data

US 2004/0055861 A1 Mar. 25, 2004

(30) Foreign Application Priority Data

Aug. 6, 2002 (TW) ..... 91212102 U

(51) Int. Cl.[7] ..... H01H 25/04
(52) U.S. Cl. ..... 200/6 A
(58) Field of Search ..... 200/4, 5 R, 6 A, 200/17 R, 18, 406, 332, 335; 345/157, 161; 463/36–38; 341/20; 273/148 R; 74/471

(56) References Cited

U.S. PATENT DOCUMENTS 6,262,381 B1 * 7/2001 Kikuchi et al. ..... 200/6 A
6,348,664 B2 * 2/2002 Kozuma ..... 200/6 A
6,593,909 B1 * 7/2003 Chou ..... 200/6 A
6,657,141 B1 * 12/2003 Myojin ..... 200/6 A
6,791,037 B1 * 9/2004 Ling ..... 200/4
6,794,589 B2 * 9/2004 Kubat et al. ..... 200/6 A
6,809,274 B2 * 10/2004 Takeuchi et al. ..... 200/6 A
6,897,391 B2 * 5/2005 Gavalda ..... 200/6 A

* cited by examiner

*Primary Examiner*—Michael A. Friedhofer
(74) *Attorney, Agent, or Firm*—Frommer Lawrence & Haug LLP; Ronald R. Santucci

(57) ABSTRACT

A multi-directional switch includes a conductive member with a central contact portion and four side contact portions. A push key can be actuated to press a selected one of four interconnected, conductive, resilient plate portions of an annular peripheral plate or a conductive, resilient plate portion of a central plate against a corresponding one of the central contact portion and the side contact portions. Upon release of the push key, the resilient plate portions of the central plate and the peripheral plate can return the push key to a normal position.

8 Claims, 12 Drawing Sheets

MULTI-DIRECTIONAL SWITCH

CROSS-REFERENCE TO RELATED APPLICATION

This application claims priority of Taiwanese Application No. 091212102, filed on Aug. 6, 2002.

BACKGROUND OF THE INVENTION

1. Field of the Invention

This invention relates to a switch, and more particularly to a multi-directional switch.

2. Description of the Related Art

Multi-directional switches are widely found in cellular phones and personal digital assistants. Referring to FIGS. 1 and 2, a first conventional multi-directional switch 1 is shown to include a plurality of contact legs 11, a base 12, four rectangular resilient conductive peripheral plates 13, a circular resilient conductive central plate 14, a key seat 15, a push key 16, a top plate 17, and an annular retaining element 18. The plates 13, 14 cooperate to bias the push key 16 to a normal position. The first conventional multi-directional switch 1 has a disadvantage in that it is difficult to position the plates 13 between the base 12 and the top plate 17 during assembly.

Referring to FIGS. 3 and 4, a second conventional multi-directional switch 2 is shown to include a plurality of contact legs 21, a base 22, five circular resilient conductive plates 23, a key seat 24, a push key 25, and a cover 26. The second conventional multi-directional switch 2 has the same disadvantage as the first conventional multi-directional switch 1 (see FIGS. 1 and 2).

SUMMARY OF THE INVENTION

The object of this invention is to provide a multi-directional switch that includes a central plate and a peripheral plate, which cooperate to bias a push key to a normal position and which can be positioned easily on a base during assembly.

According to this invention, a multi-directional switch includes a conductive member with a central contact portion and four side contact portions. A push key can be actuated to press a selected one of four interconnected, conductive, resilient plate portions of an annular peripheral plate or a conductive, resilient plate portion of a central plate against a corresponding one of the central contact portion and the side contact portions. Upon release of the push key, the resilient plate portions of the central plate and the peripheral plate can return the push key to a normal position. Because the resilient plate portions of the peripheral plate are interconnected fixedly by four insulating bridging portions, the peripheral plate can be positioned easily on a base during assembly.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
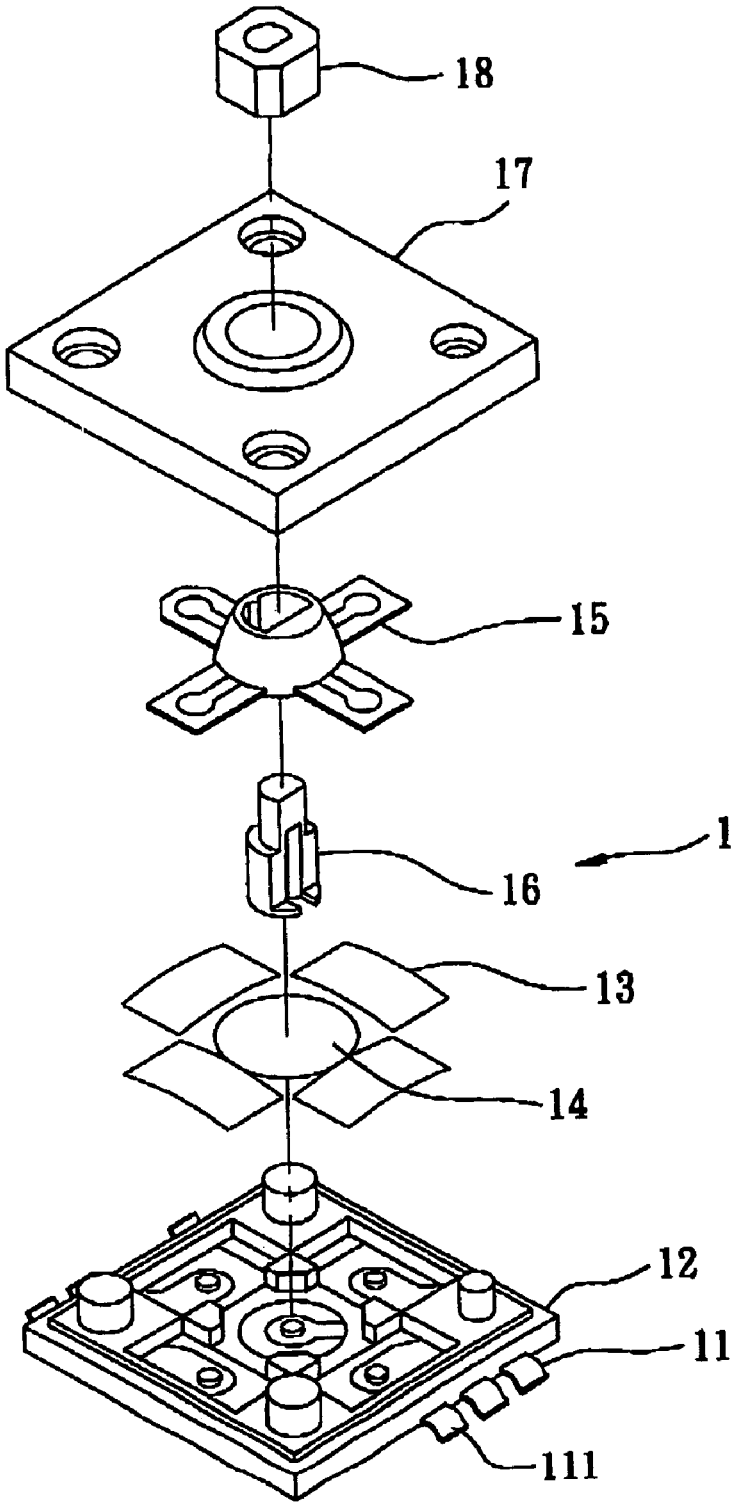
FIG. 1 PRIOR ART
FIG. 1 is a partly exploded perspective view of a first conventional multi-directional switch.
Figure 2:
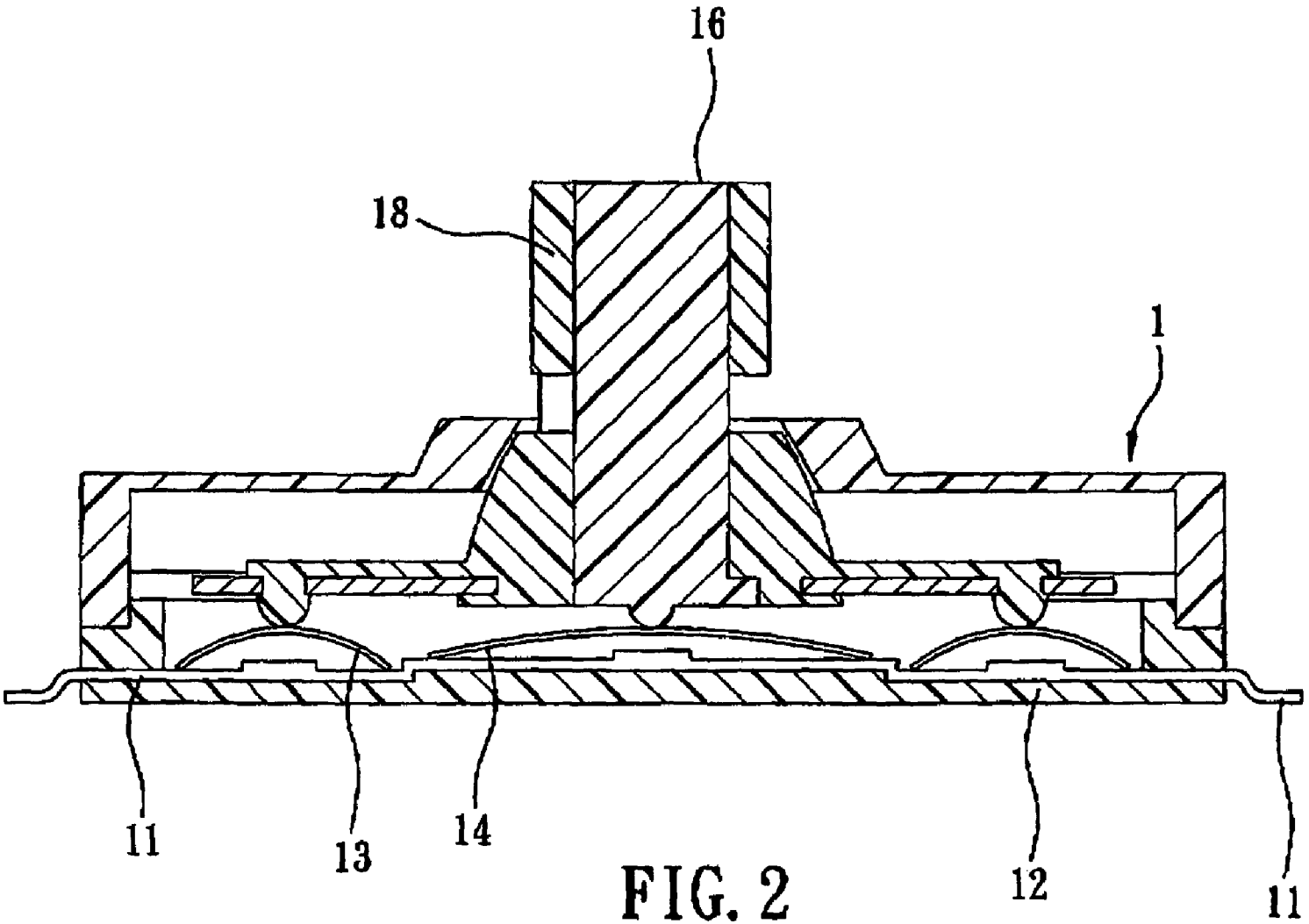
FIG. 2 PRIOR ART
FIG. 2 is a sectional view of the first conventional multi-directional switch.
Figure 3:
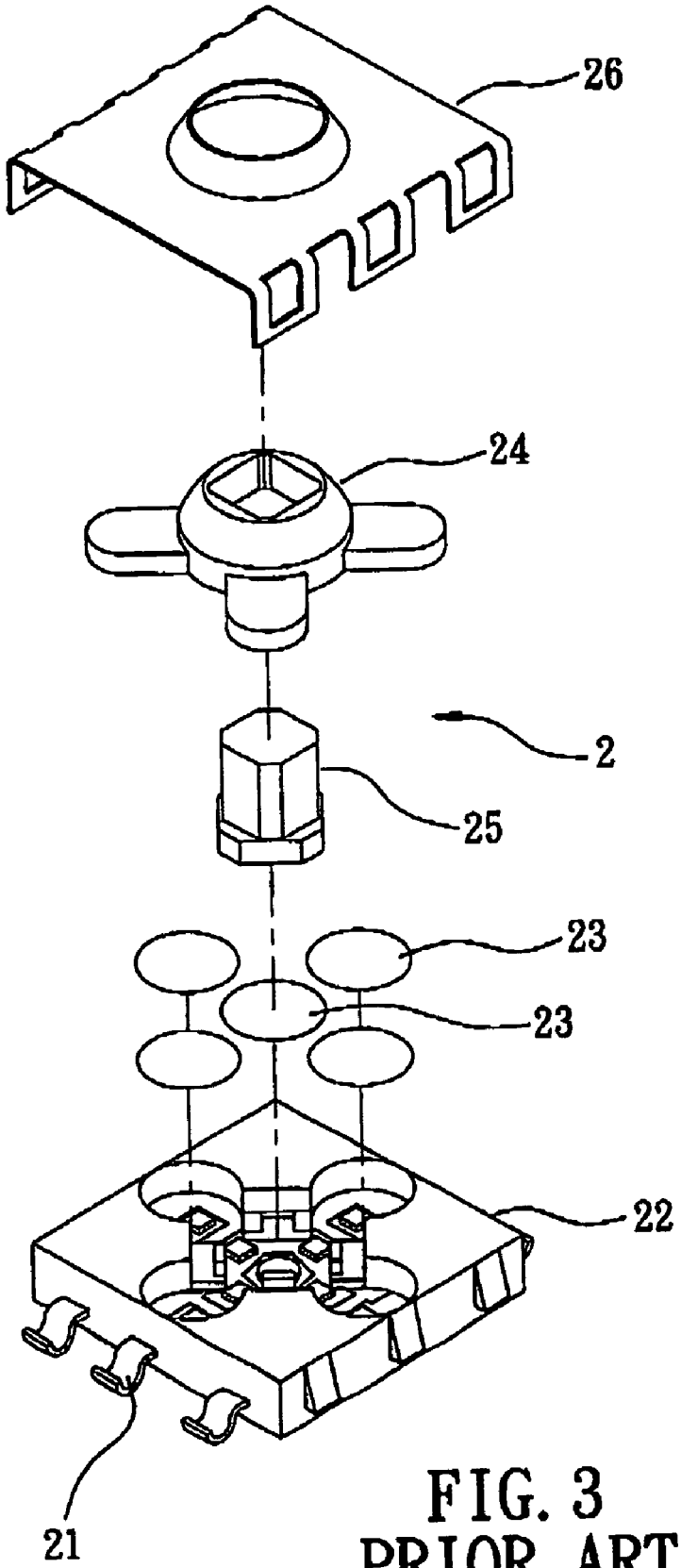
FIG. 3 PRIOR ART
FIG. 3 is a partly exploded perspective view of a second conventional multi-directional switch.
Figure 4:
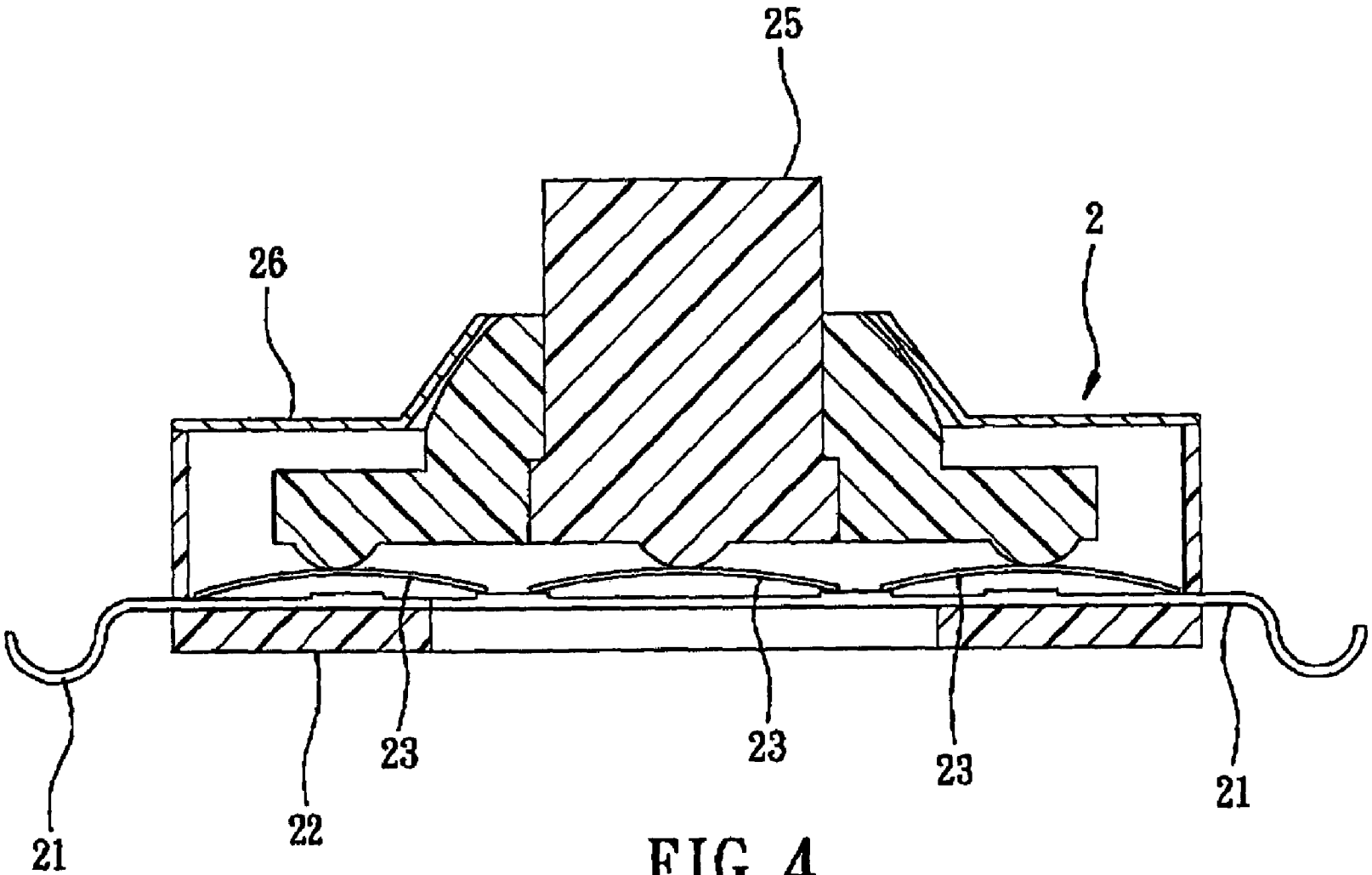
FIG. 4 PRIOR ART
FIG. 4 is a sectional view of the second conventional multi-directional switch.
Figure 5:
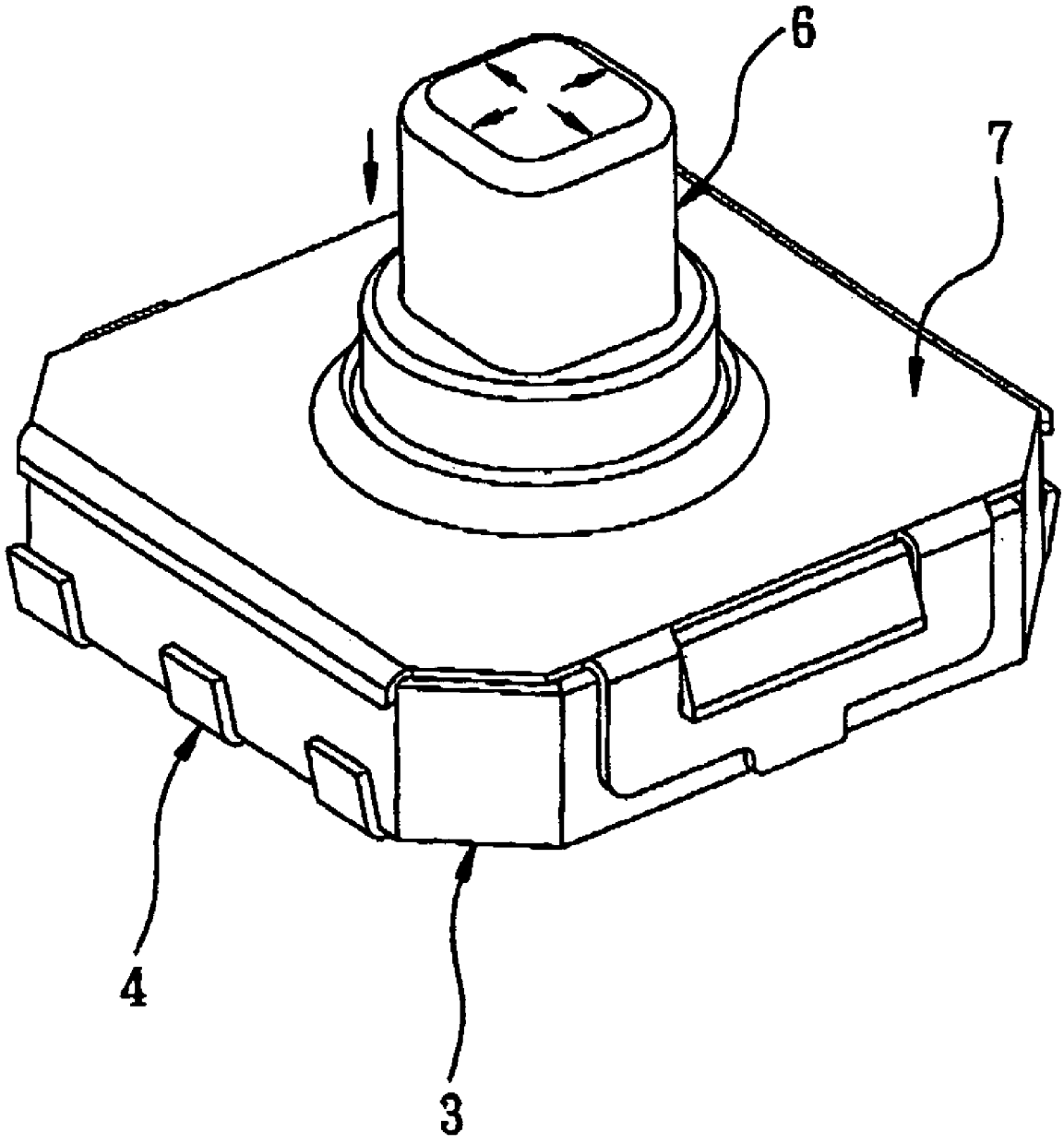
FIG. 5 is an assembled perspective view of the preferred embodiment of a multi-directional switch according to this invention.
Figure 6:
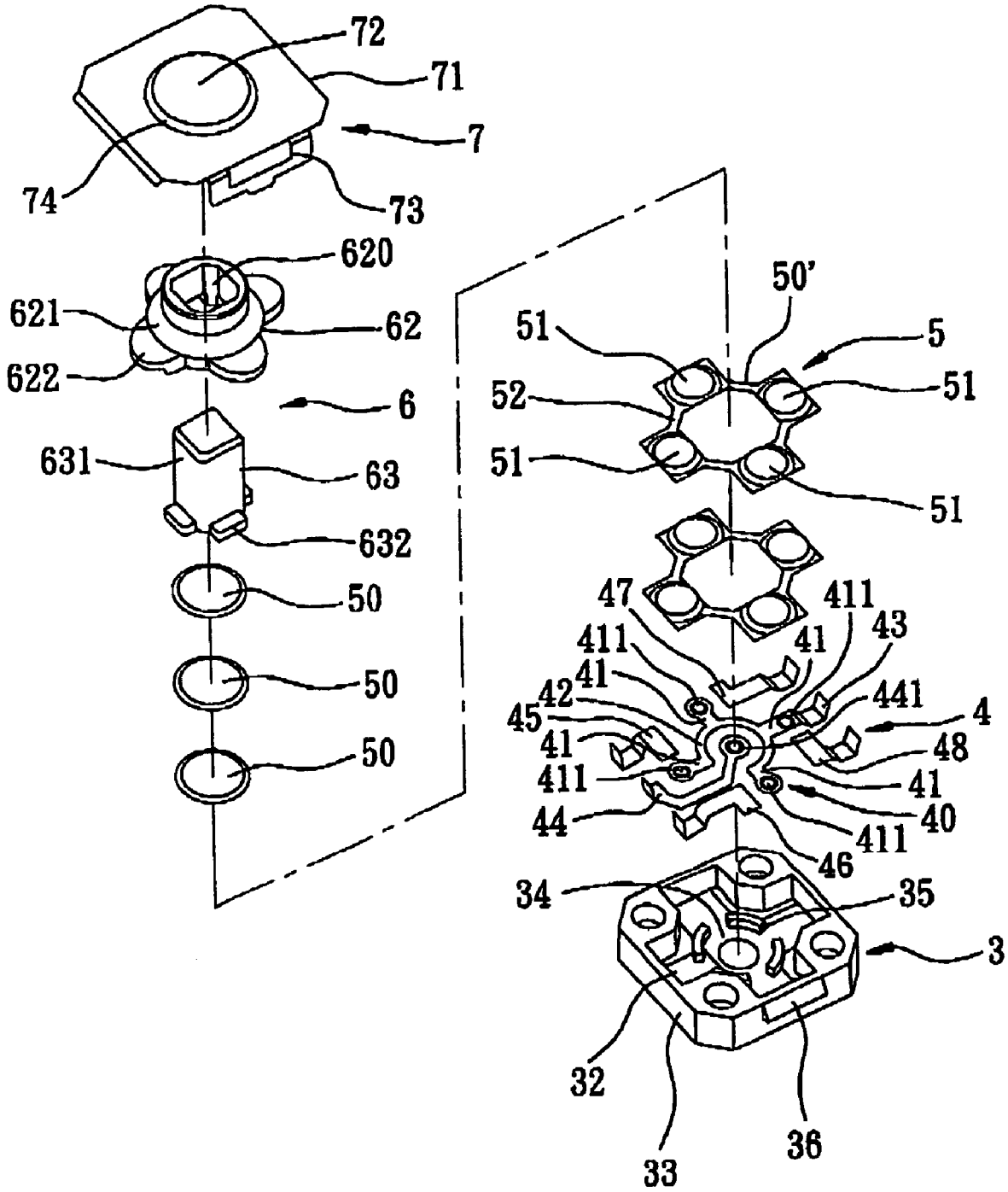
FIG. 6 is an exploded perspective view of the preferred embodiment.
Figure 7:
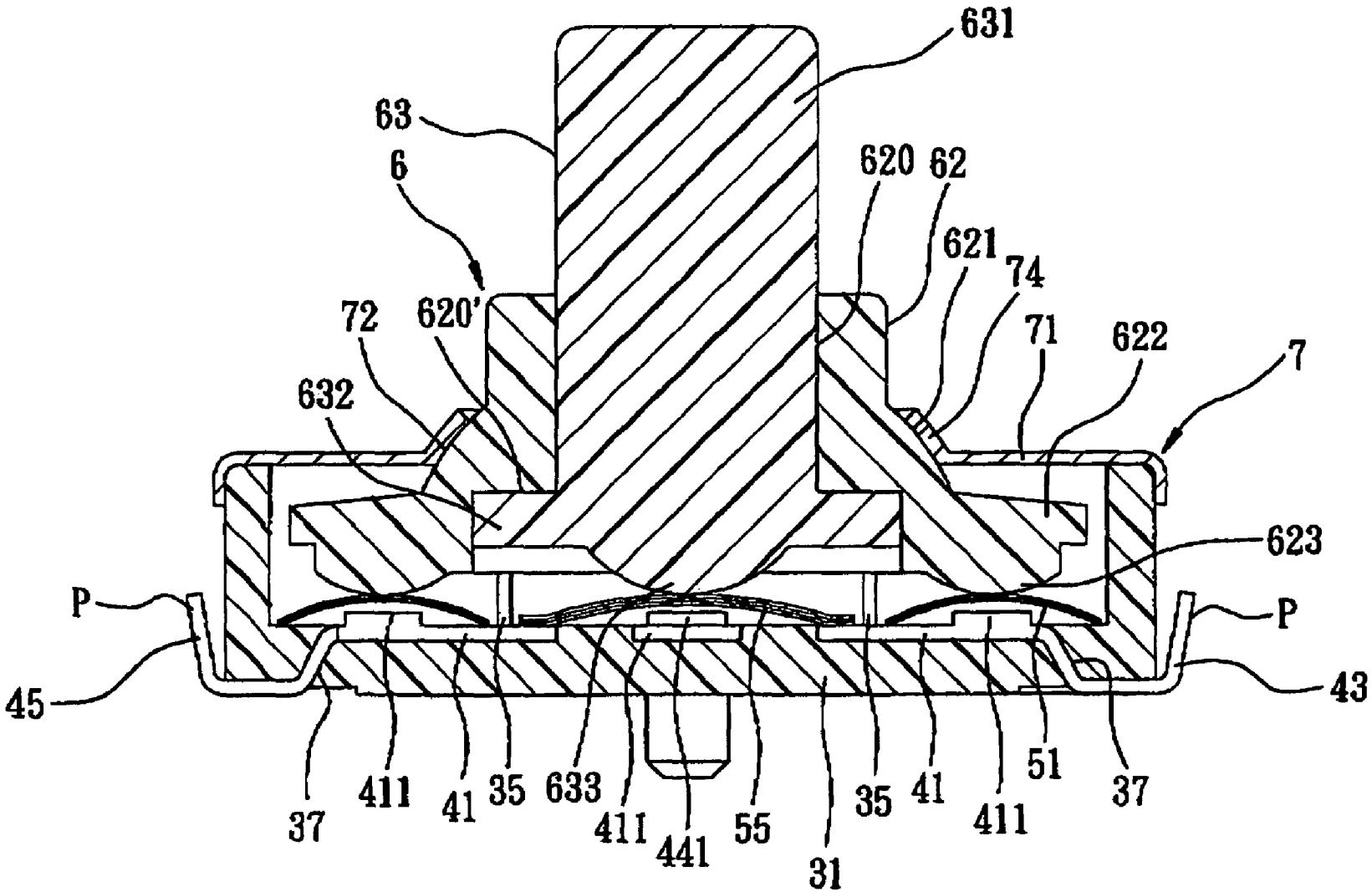
FIG. 7 is a sectional view of the preferred embodiment, illustrating a normal position of a push key.

Referring to FIGS. 5, 6, and 7, the preferred embodiment of a multi-directional switch according to this invention is shown to include a base 3, a contact leg assembly 4, a resilient plate assembly 5, a pressing mechanism 6, and an annular top cover 7.

The base 3 is made of plastic, and includes a horizontal bottom wall 31 (see FIG. 7), a receiving chamber 32 defined by a surrounding wall 33 extending upwardly from an outer periphery of the bottom wall 31, a circular confining space 34 defined by four curved ribs 35 that are arranged along a circle, two lateral projections 36 (only one is shown in FIG. 6) extending from two opposite side surfaces of the surrounding wall 33, and six leg holes 37 formed through the base 3 and communicated with the receiving chamber 32.

The contact leg assembly 4 is disposed within the receiving chamber 32 in the base 3, and includes a conductive member 40 with four angularly equidistant radial arms 41 extending integrally, radially, and outwardly from a C-shaped central contact portion 42, a common contact leg 43 extending integrally from the central contact portion 42, a central contact leg 44, and four side contact legs 45, 46, 47, 48. The C-shaped central contact portion 42 is confined within the receiving space 34 in the base 3. Each of the radial arms 41 extends between an adjacent pair of the curved ribs 35 so as to position the conductive member 40 in the base 3, and has an outer end that is formed with a side contact portion 411 which projects upward therefrom. The central contact leg 44 has an end that is formed with a contact portion 441 which projects upward therefrom, which is disposed within the C-shaped central contact portion 42 of the conductive member 40, and which is surrounded by the side contact portions 411. The common contact leg 43, the central contact leg 44, and the side contact legs 45, 46, 47, 48 extend respectively through the leg holes 37 in the base 3. Preferably, the base 3 is molded on the contact legs 43, 44, 45, 46, 47, 48 so that the latter are fixed on the former. The contact legs 43, 44, 45, 46, 47, 48 have plate-shaped upright outer ends (P) that project from two opposite side wall portions of the surrounding wall 33 of the base 3, as shown in FIG. 7. As such, a plurality of vertical printed circuit boards (not shown) are able to be connected electrically to the contact legs 43, 44, 45, 46, 47, 48 such that the upright outer ends (P) of the contact legs 43, 44, 45, 46, 47, 48 are clamped between the printed circuit boards and the surrounding wall 33 of the base 3, thereby reducing the volume of the switch of this invention effectively.

Figure 8:
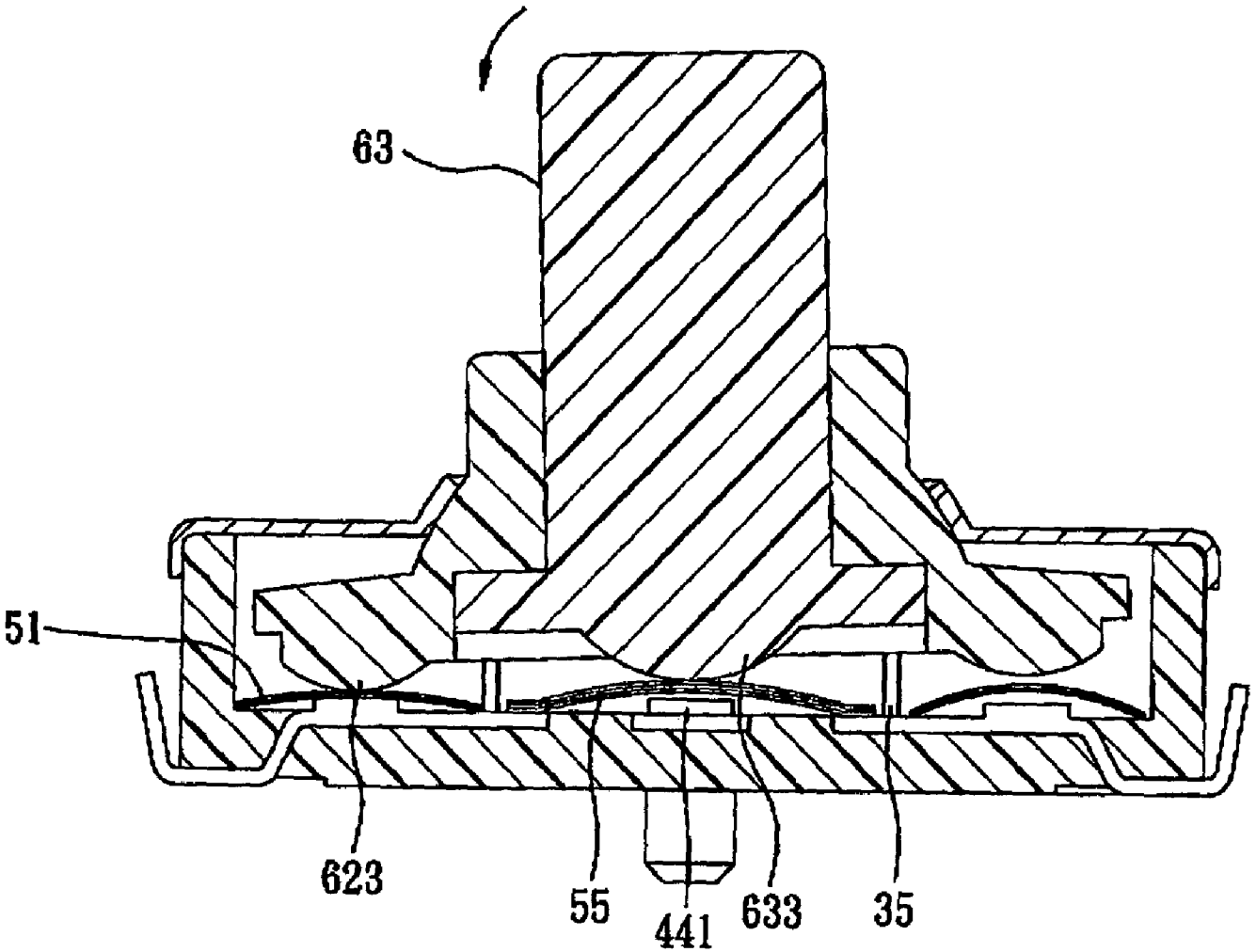
FIG. 8 is a sectional view of the preferred embodiment, illustrating a pressed position of the push key.

The resilient plate assembly 5 includes a central plate unit consisting of three superposed conductive central plates 50, and a peripheral plate unit consisting of two superposed conductive peripheral plates 50'. Each of the central plates 50 is shaped as a dome that has a central portion which constitutes an upwardly convex resilient plate portion. The central plates 50 are surrounded by the curved ribs 35 so as to retain an outer periphery of the lowermost central plate 50 on the C-shaped central plate portion 42 of the conductive member 40, thereby establishing electrical connection between the common contact leg 43 and the central plates 50, as shown in FIGS. 7 and 8.

Figure 11:
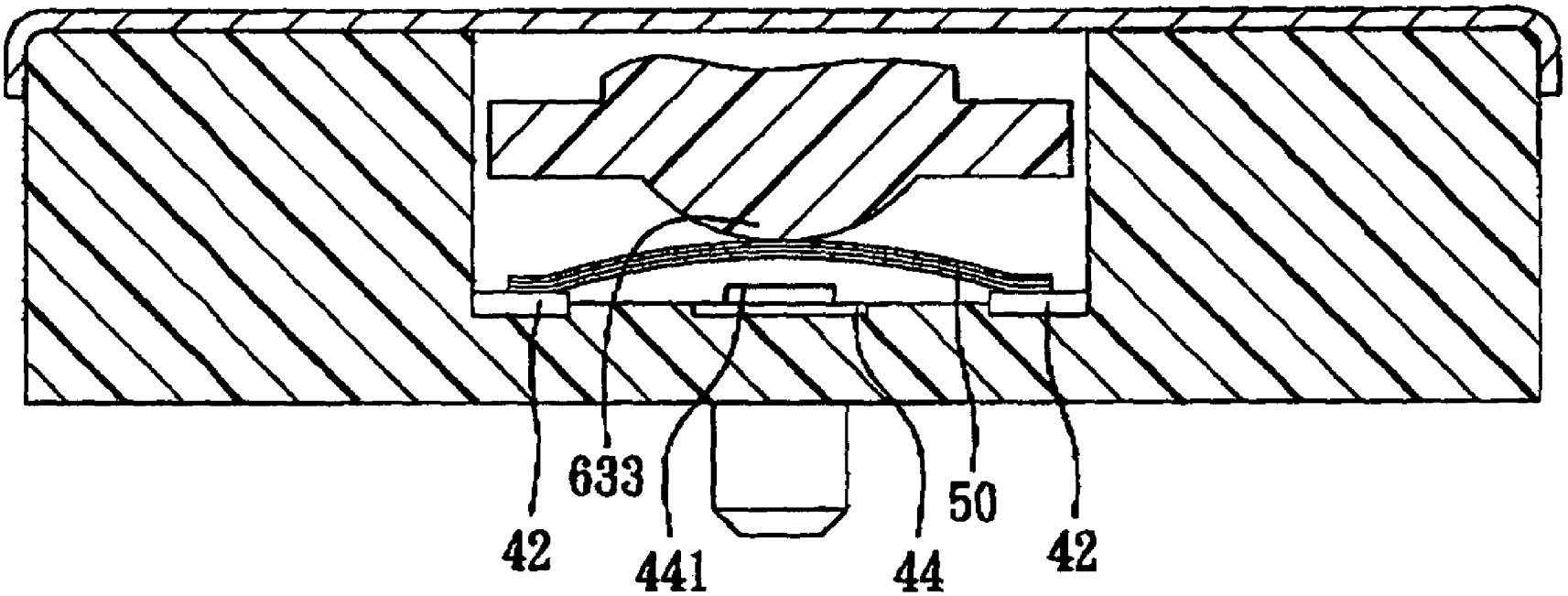
FIG. 11 is a schematic fragmentary view of the preferred embodiment, illustrating how an electrical connection between a central contact leg and a central contact portion of the conductive member is interrupted.
Figure 12:
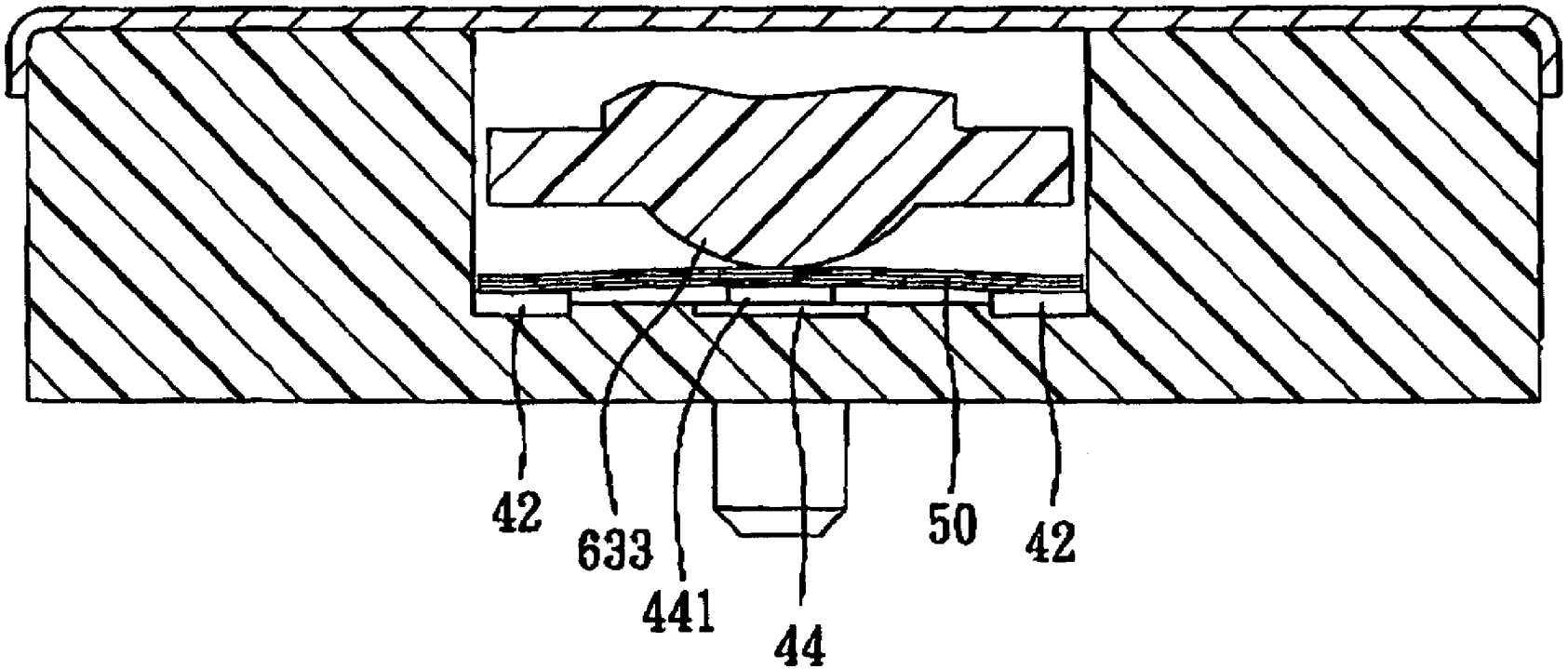
FIG. 12 is a schematic fragmentary view of the preferred embodiment, illustrating how the electrical connection between the central Contact leg and the central contact portion of the conductive member is established.

Each of the resilient plate portions of the central plates 50 is disposed at a non-actuated position shown in FIG. 11, where the resilient plate portion of the, lowermost central plate 50 is spaced apart from the contact portion 441 of the central contact leg 44, and is capable of being pressed to move to an actuated position shown in FIG. 12, where the resilient plate portion of the lowermost central plate 50 is in electrical contact with the contact portion 441 of the central contact leg 44, after which the resilient plate portions of the central plates 50 can return to the non-actuated position when released.

Figure 9:
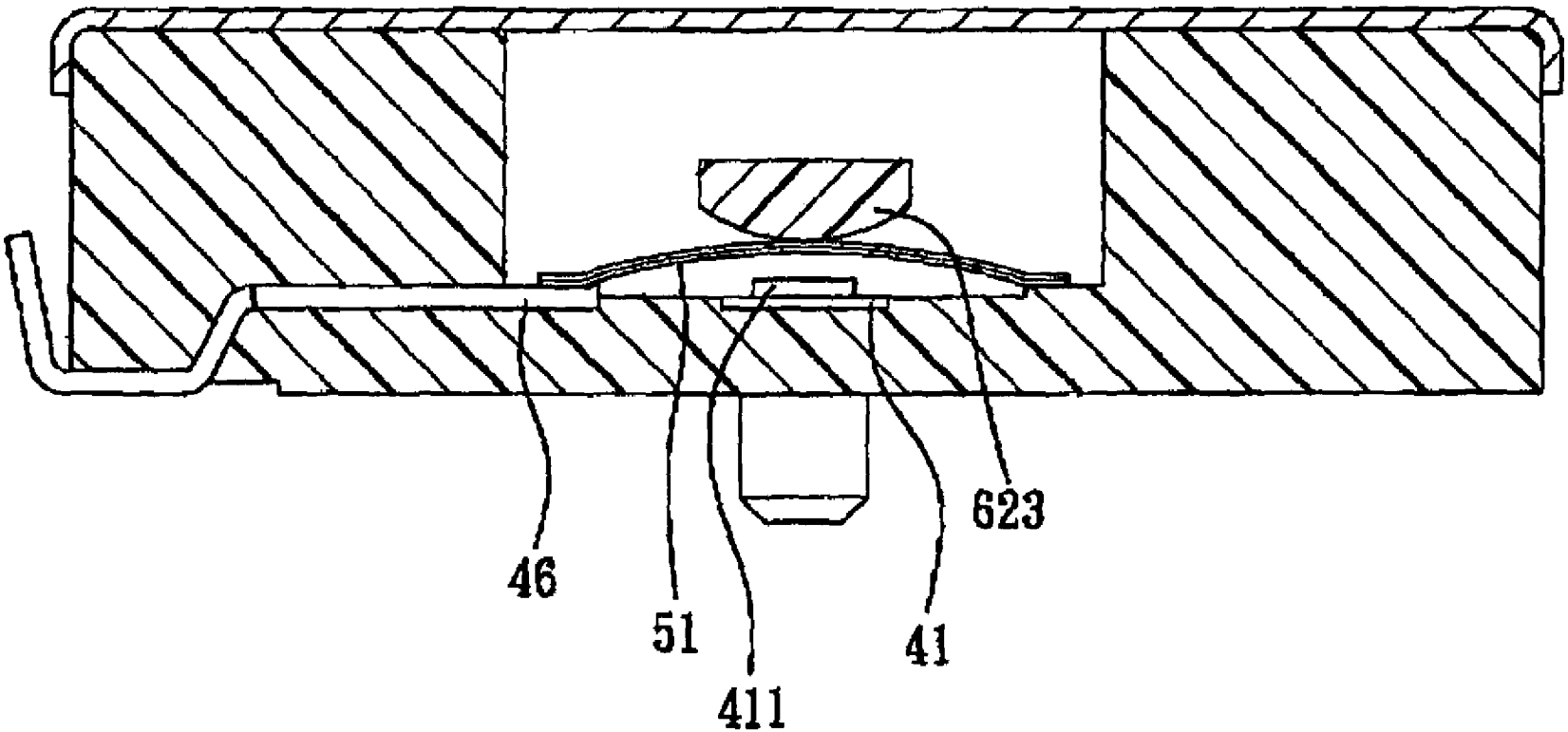
FIG. 9 is a schematic fragmentary view of the preferred embodiment, illustrating how an electrical connection between a side contact leg and a side contact portion of a conductive member is interrupted.
Figure 10:
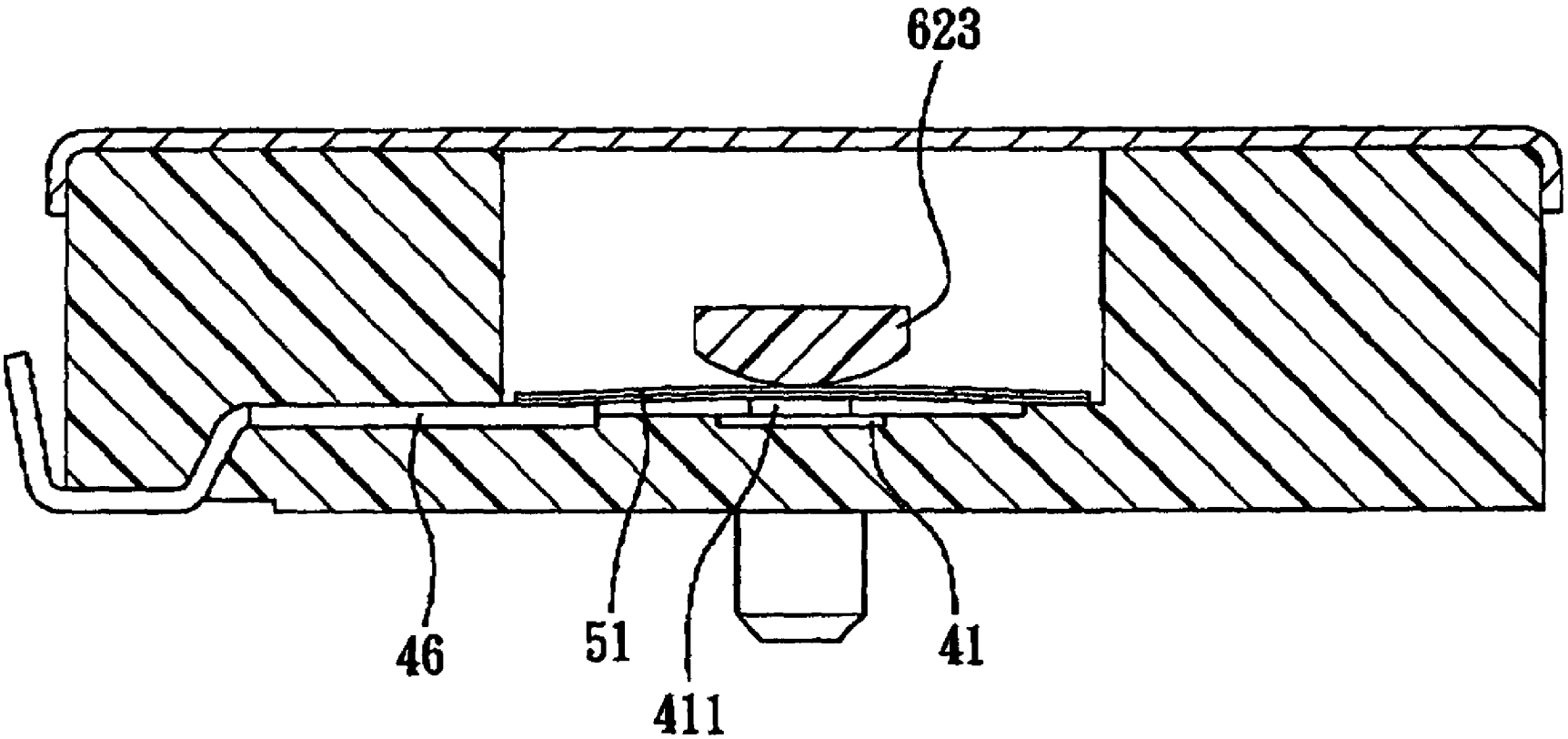
FIG. 10 is a schematic fragmentary view of the preferred embodiment, illustrating how the electrical connection between the side contact leg and the side contact portion of the conductive member is established.

Each of the peripheral plates 50' is annular, and has four dome-shaped conductive portions 51 disposed around the central plates 50, and four insulating bridging plate portions 52. Each adjacent pair of the conductive portions 51 of each of the peripheral plates 50' are interconnected fixedly by a respective one of the bridging plate portions 52. Each conductive portion 51 of the lower peripheral plate 50' has an outer periphery in electrical contact with a respective one of the side contact legs 45, 46, 47, 48, as shown in FIGS. 9 and 10. Each of the conductive portions 51 of the peripheral plates 50' has a central portion constituting an upwardly convex resilient plate portion that is disposed at a non-pressed position shown in FIG. 9, where the corresponding conductive portions 51 is spaced apart from the corresponding side contact portion 411 of the conductive member 40, and that can be pressed to move to a pressed position shown in FIG. 10, where the corresponding conductive portions 51 is in electrical contact with the corresponding side contact portion 411 of the conductive member 40 so as to establish electrical connection between the corresponding side contact portion 411 of the conductive member 40 and the corresponding side contact leg 45, 46, 47, 48, after which the resilient plate portion of the corresponding conductive portion 51 can return to the non-pressed position when released.

The top cover 7 includes a horizontal wall 71 with a vertical central hole 72 formed therethrough, two U-shaped resilient plates 73 (only one is shown in FIG. 6) extending respectively and downwardly from two opposite sides of the horizontal wall 71 and engaging respectively the lateral projections 36 of the base 3 so as to retain the top cover 7 on the base 3, and a truncated conical annular wall portion 74 defining an upper end portion of the central hole 72.

The pressing mechanism 6 includes an annular key seat 62 with a rectangular central hole 620 formed therethrough, and a push key 63 that has a rectangular-cross-sectioned upper portion 631 which extends through and which is received fittingly within the central hole 620 in the key seat 62 so as to permit synchronous swinging movement of the key seat 62 and the push key 63. The key seat 62 has a truncated conical portion 621 that engages the truncated conical wall portion 74 of the top cover 7 so as to permit swinging movement of the key seat 62 relative to the top cover 7, and four pressing portions 622 projecting outwardly from a lower end of the key seat 62. The push key 63 has a lower end that is formed with four projections 632 which are disposed within an enlarged lower end portion 620' (see FIG. 7) of the central hole 620 in the key seat 62 so as to prevent upward removal of the push key 63 from the key seat 62.

As such, the push key 63 can be pressed in a substantially vertical direction to move downward within the key seat 62 so as to press a downward projection 633 (see FIGS. 7 and 8) on a lower end surface of the push key 63 against the central plates 50, thereby establishing electrical connection between the central contact leg 44 and the common contact leg 43, as shown in FIG. 12. Alternatively, the push key 63 can be pressed in an inclined direction to swing an assembly of the key seat 62 and the push key 63 relative to the base 3 so as to press a downward projection 623 (see FIGS. 7 and 8) of a selected one of the pressing portions 622 of the key seat 62 against the corresponding conductive portion 51 of the peripheral plates 50', thereby establishing electrical connection between the common contact leg 43 and the corresponding side contact leg 45, 46, 47, 48, as shown in FIGS. 8 and 10.

The advantages of the multi-directional switch of this invention can be summarized as follows:

1. Because the conductive portions 51 of each of the peripheral plates 50' are interconnected by the bridging portions 52, they can be positioned easily within the base 3 during assembly.
2. Since the central plate unit includes three superposed central plates 50, when one of the central plates 50 malfunctions, the other two central plates 50 will be able to establish electrical connection between the central contact leg 44 and the common contact leg 43 and to bias the push key 63 to its normal position. Similarly, when one of the peripheral plates 50' malfunctions, the other peripheral plate 50' will be able to establish electrical connection between the common contact leg 43 and the selected one of the side contact legs 45, 46, 47, 48.
3. Each of the outer ends (P) of the contact legs 43, 44, 45, 46, 47, 48 extends along a direction generally parallel to an axial direction of the central hole 620 in the key seat 62, and is able to be pressed against the surrounding wall 33 of the base 3. Accordingly, vertical printed circuit boards connected to the contact legs 43, 44, 45, 46, 47, 48 can be disposed adjacent to the surrounding wall 33 of the base 3 to clamp the upright outer ends (P) of the contact legs 43, 44, 45, 46, 47, 48 between the surrounding wall 33 of the base 3 and the printed circuit boards, thereby reducing the volume of the switch of this invention significantly.

With this invention thus explained, It is apparent that numerous modification and variations can be made without departing the scope and spirit of this invention. It is therefore intended that this invention be limited only as indicated by the appended claims.

I claim:

1. A multi-directional switch comprising:

a base;

a contact leg assembly including a conductive member fixed on said base and having a central contact portion, and four side contact portions that are disposed around said central contact portion, a common contact leg fixed on said base and connected electrically to said conductive member, a central contact leg fixed on said base and spaced apart from and adjacent to said central contact portion of said conductive member, and four side contact legs fixed on said base and spaced respectively apart from and respectively adjacent to said side contact portions of said conductive member;

a resilient plate assembly including a central plate unit positioned on said base and including at least one conductive central plate that has an upwardly convex resilient plate portion which is connected electrically to said central contact portion of said conductive member and which is disposed at a non-actuated position, where said resilient plate portion of said central plate is spaced apart from said central contact leg, and which is capable of being pressed to move to an actuated position, where said resilient plate portion of said central plate is in electrical contact with said central contact leg, after which said resilient plate portion of said central plate can return to said non-actuated position when released, a peripheral plate unit positioned on said base and including at least one annular peripheral plate that has four conductive portions disposed around said central plate, and four insulating bridging plate portions, each adjacent pair of said conductive portions of said peripheral plate being interconnected fixedly by a respective one of said bridging plate portions, each of said conductive portions of said peripheral plate being in electrical contact with a respective one of said side contact legs and having an upwardly convex resilient plate portion that is disposed at a non-pressed position, where a corresponding one of said conductive portions of said peripheral plate is spaced apart from a corresponding one of said side contact portions of said conductive member, and that is capable of being pressed to move to a pressed position, where the corresponding one of said conductive portions of said peripheral plate is in electrical contact with the corresponding one of said side contact portions of said conductive member so as to establish electrical connection between the corresponding one of said side contact portions of said conductive member and the respective one or said side contact legs, after which the corresponding one of said resilient plate portions of said peripheral plate can return to said non-pressed position when released, and an annular top cover fixed on said base; and a pressing mechanism including a key seat extending through said top cover and swingable on said base, said key seat having a central hole and four pressing portions, and a push key extending through and disposed axially and movably within said central hole in said key seat so as to permit synchronous swinging movement of said key seat and said push key, said push key being movable within said central hole in said key seat to press said resilient plate portion of said central plate against said central contact leg and being capable of being actuated to press a selected one of said pressing portions of said key seat against a corresponding one of said resilient plate portions of said peripheral plate so as to move the corresponding one of said resilient plate portions of said peripheral plate to said pressed position.

2. The multi-directional switch as claimed in claim 1, wherein said peripheral plate unit includes two superposed ones of said peripheral plates, each of said conductive portions of one of said peripheral plates overlapping a respective one of said conductive portions of the other one of said peripheral plates.

3. The multi-directional switch as claimed in claim 1, wherein said central plate unit includes a plurality of superposed ones of said central plates, said resilient plate portion of each of said central plates being aligned with said resilient plate portions of the remainder of said central plates.

4. The multi-directional switch as claimed in claim 1, wherein said base has six leg holes, each of said common contact leg, said central contact leg, and said side contact legs extending through a respective one of said leg holes in said base and having a plate-shaped outer end that extends in a direction that is generally parallel to an axial direction of said central hole in said key seat.

5. The multi-directional switch as claimed in claim 1, wherein said central plate is shaped as a dome that has a central portion which constitutes said resilient plate portion of said central plate.

6. The multi-directional switch as claimed in claim 1, wherein each of said conductive portions of said peripheral plate is shaped as a dome that has a central portion which constitutes said resilient plate portion of said conductive portion of said peripheral plate.

7. The multi-directional switch as claimed in claim 1, wherein said base is formed with a plurality of curved ribs that are arranged along a circle and that cooperate to define a circular confining space, said central plate being shaped as a dome and being confined within said confining space.

8. The multi-directional switch as claimed in claim 7, wherein said central contact portion of said conductive member is C-shaped, said conductive member further having four angularly equidistant radial arms that extend integrally, radially, and outwardly from said central contact portion, each of said radial arms extending between an adjacent pair of said curved ribs and having an outer end that is formed with a respective one of said side contact portions.

* * * * *